United States Patent [19]

Okauchi et al.

[11] Patent Number: 4,950,637

[45] Date of Patent: Aug. 21, 1990

[54] HEAT SENSITIVE RECORDING MATERIAL

[75] Inventors: Shuki Okauchi, Osaka; Toshitake Suzuki, Kobe; Yoshiyuki Nukushina; Masato Kawamura, both of Amagasaki, all of Japan

[73] Assignee: Kanzaki Paper Manufacturing Co. Ltd., Tokyo, Japan

[21] Appl. No.: 334,061

[22] Filed: Apr. 6, 1989

[30] Foreign Application Priority Data

Apr. 13, 1988 [JP] Japan ..... 63-90546

[51] Int. Cl.[5] ..... B41M 5/18

[52] U.S. Cl. ..... 503/209; 427/150; 503/208; 503/214; 503/221; 503/226

[58] Field of Search ..... 427/150–152; 503/208, 209, 214, 221, 226

[56] References Cited

U.S. PATENT DOCUMENTS 4,473,831 9/1984 Watanabe ..... 503/209
4,771,033 9/1988 Shimizu et al. ..... 503/209

FOREIGN PATENT DOCUMENTS 0160191 9/1983 Japan ..... 503/209

*Primary Examiner*—Bruce H. Hess
*Attorney, Agent, or Firm*—Armstrong, Nikaido, Marmelstein, Kubovcik & Murray

[57] ABSTRACT

In a heat sensitive recording material comprising a substrate and a heat sensitive recording layer thereon incorporating a colorless or light-colored basic dye and a color acceptor which is reactive with the dye to form a color when contacted therewith, the recording material characterized in that at least one of the compounds of the formula (I) is contained in the heat sensitive recording layer

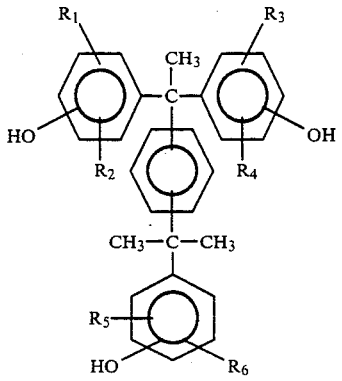

(I)

wherein $R_1$, $R_2$, $R_3$, $R_4$, $R_5$ and $R_6$ are same or different and are hydrogen atom, halogen atom, $C_1 \sim C_5$ alkyl or $C_1 \sim C_5$ alkoxyl.

7 Claims, No Drawings

HEAT SENSITIVE RECORDING MATERIAL

The present invention relates to a heat sensitive recording material, and more particularly to a heat sensitive recording material having excellent preservability of the record images.

Heat sensitive recording materials are well known which are adapted to produce record images by thermally contacting a colorless or light-colored basic dye with color acceptor for a color forming reaction.

However, these heat sensitive recording materials are generally insufficient in the preservability of the record images and have a problem that the record images are apt to fade with a lapse of time. Particularly, under circumstance of high humidity or high temperature, the record images disappear in considerably short period. Thus, the improvement thereof has been strongly demanded.

Although heat sensitive recording materials having incorporated therein various preservability-improving agents are proposed in order to improve the preservability of the record images, recording materials having sufficient qualities are not necessarily obtained because whiteness of the recording layers lowers with improvement of the preservability of the record images.

In view of the above, the inventors of the present invention have investigated preservability-improving agents contained in the recording layer, and have found that the preservability of the record images can be improved by use of the compound of the formula (I) without accompanying a newly arised defect that the recording layer becomes low in whiteness and the recording material is apt to fog when exposed to high temperature or high humidity.

In a heat sensitive recording material comprising a substrate and a heat sensitive recording layer thereon incorporating a colorless or light-colored basic dye and a color acceptor which is reactive with the dye to form a color when contacted therewith, the present invention provides the recording material characterized in that at least one of the compounds of the formula (I) is contained in the heat sensitive recording layer

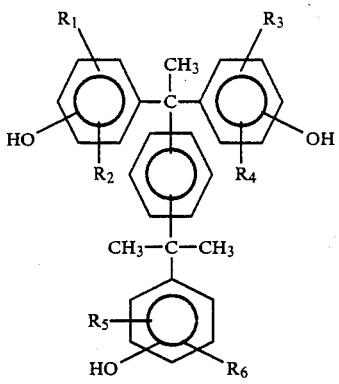

(I)

wherein $R_1$, $R_2$, $R_3$, $R_4$, $R_5$ and $R_6$ are same or different and are hydrogen atom, halogen atom, $C_1 \sim C_5$ alkyl or $C_1 \sim C_5$ alkoxyl.

Examples of the compounds of the formula (I) are 1-[α-methyl-α-(4'-hydroxyphenyl)ethyl]-4-[α',α'-bis(4''-hydroxyphenyl)ethyl]benzene, 1-[α-methyl-α-(4'-hydroxyphenyl)ethyl]-3-[α',α'-bis(4''-hydroxyphenyl)ethyl]benzene, 1-[α-methyl-α-(3',5'-dimethyl-4'-hydroxyphenyl)ethyl]-4-[α',α'-bis(3'',5''-dimethyl-4''-hydroxyphenyl)ethyl]benzene, 1-[α-methyl-α-(3'-methyl-4'-hydroxyphenyl)ethyl]-4-[α',α'-bis(3''-methyl-4''-hydroxyphenyl)ethyl]benzene, 1-[α-methyl-α-(3',5'-dichloro-4'-hydroxyphenyl)ethyl]-4-[α',α'-bis(3'',5''-dichloro-4''-hydroxyphenyl)ethyl]benzene and 1-[α-methyl-α-(3'-methoxy-4'-hydroxyphenyl)ethyl]-4-[α',α'-bis(3''-methoxy-4''-hydroxyphenyl)ethyl]benzene. These compounds are used singly or at least two of them can be used. In the present invention, the preservability of the record images can be improved by incorporating the compound of the formula (I) into a heat sensitive recording layer. The compound is used in an amount of 1 to 1000 parts by weight, preferably 10 to 300 parts by weight per 100 parts by weight of the color acceptor.

As a basic dye contained in the heat sensitive recording layer in the present invention are used various colorless or light-colored basic dyes. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bis-dimethylaminobenzhydryl benzyl ether, N-halophenylleucoauramine, N-2,4,5-trichlorophenyl-leucoauramine, etc.

Thiazine-based dyes, e.g., benzoyl-leucomethyleneblue, p-nitrobenzoyl-leucomethyleneblue, etc.

Spiro-based dyes, e.g., 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran, etc.

Lactam-based dyes, e.g., rhodamine-B-anilinolactam, rhodamine-(p-nitroanilino)lactam, rhodamine-(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-di(n-butyl)amino-6-methyl-7-phenylaminofluoran, 3-diethylamino-7-(2-carbomethoxyphenyl)aminofluoran, 3-(N-cyclohexyl-N-methyl-)amino-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenyl-)aminofluoran, 3-di(n-butyl)amino-7-(o-chlorophenyl-)aminofluoran, 3-pyrrolidino-6-methyl-7-p-butylphenylaminofluoran, 3-(N-methyl-N-n-amyl)amino-6-methyl-7-phenylaminofluoran, 3-(N-ethyl-N-n-amyl-)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-β-ethylhexyl-)amino-6-methyl-7-phenylaminofluoran, 3-(N-ethyl-N-tetrahydrofurfuryl)amino-6-methyl-7-phenylaminofluoran, 3-(N-ethyl-N-cyclopentyl)amino-6-methyl-7-phenylaminofluoran, etc. These basic dyes are not limited thereabove and can be used, as required, in a mixture of at least two of them.

Among these dyes, preferable are 3-di(n-butyl)amino-6-methyl-7-phenylaminofluoran, 3-(N-ethyl-N-isoamyl-)amino-6-methyl-7-phenylaminofluoran and 3-di(n-butyl)amino-7-(o-chlorophenyl)aminofluoran. These dyes, when used in combination with the present specific compound, provide a heat sensitive recording material which is excellent not only in whiteness of the recording layer and the preservability of the record images but also in the recording density. Further, most preferable are 3-di(n-butyl)amino-6-methyl-7-phenylaminofluoran and 3-di(n-butyl)amino-7-(o-chlorophenyl)aminofluoran which can afford a heat sensitive recording material which is extremely low in decrease of whiteness when exposed to high temperature.

As a color acceptor are used various compounds which form color in contact with the basic dyes. Examples thereof are 4-tert-butylphenol, α-naphthol, β-naphthol, 4-acetylphenol, 4-tert-octylphenol, 4,4'-sec-butylidenediphenol, 4-phenylphenol, 4,4'-dihydroxydiphenylmethane, 4,4'-isopropylidenediphenol, hydroquinone, 4,4'-cyclohexylidenediphenol, 4,4'-(1,3-dimethylbutylidene)bisphenol, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylenediphenylsulfone, 3,4-dihydroxy-4'-methyldiphenylsulfone, bis(3-allyl-4-hydroxyphenyl)sulfone, 1,3-di[2-(4-hydroxyphenyl)-2-propyl]benzene, hydroquinone monobenzyl ether, butyl bis(4-hydroxyphenyl-)acetate, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenolic polymer and like phenolic compounds; benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3,5-di-tert-butylsalicylic acid, 3-benzylsalicylic acid, 3-(α-methylbenzyl)salicylic acid, 3-chloro-5-(α-methylbenzyl)salicylic acid, 3-phenyl-5-(α,α-dimethylbenzyl)salicylic acid, 3,5-di-α-methylbenzylsalicylic acid and like aromatic carboxylic acids; also, salts of such phenolic compounds or aromatic carboxylic acids with zinc, magnesium, aluminum, calcium, titanium, manganese, tin, nickel and like polyvalent metals, etc. The above color acceptor can be used, as reqiured, in a mixture of at least two of them. Particularly, when 4-hydroxybenzoates are used as a color acceptor, the preservability of the record images is extremely improved by addition of the compound of the formula (I). Further, 4-hydroxybenzoates give a heat sensitive recording material which is excellent in whiteness.

With the heat sensitive recording materials of the invention, the proportions of basic dye and color acceptor are not particularly limited but can be determined suitably according to the kinds of basic dye and color acceptor. For example, usually 100 to 700 parts by weight, preferably 150 to 400 parts by weight, of the color acceptor is used per 100 parts by weight of the basic dye.

For preparing a coating composition comprising the foregoing components, the basic dye, the compound of the formula (I) and the color acceptor are dispersed, together or individually, into water serving as a dispersion medium, using stirring and pulverizing means such as a ball mill, attritor or sand mill. Usually the coating composition has incorporated therein a binder in an amount of 2 to 40% by weight, preferably 5 to 25% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, ethylene-acrylic acid copolymer salt, styrene-butadiene copolymer emulsion, etc. Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., defoaming agents, fluorescent dyes, coloring dyes, etc.

In addition, to the composition may be added in order to prevent the adhesion of tailings to the thermal head, inorganic pigment such as kaolin, clay, talc, calcium carbonate, calcined clay, titanium oxide, kieselguhr, finely divided anhydrous silica, activated clay, etc. Further, to the composition may be added, in order to prevent sticking upon contact of the heat sensitive recording material with a thermal head, a dispersion or emulsion of stearic acid, polyethylene, carnauba wax, paraffin wax, zinc stearate, calcium stearate, ester wax or the like.

Further, to the composition may be added in an amount which does not cause adverse effect, aliphatic fatty acid amide such as stearic acid amide, stearic acid methylenebisamide, oleic acid amide, palmitic acid amide, coconut fatty acid amide, etc; hindered phenols such as 2,2'-methylene-bis(4-methyl-6-tert-butylphenol), 4,4'-butylidenebis(6-tert-butyl-3-methylphenol), 1,1,3-tris(2-methyl-4-hydroxy-5-tert-butylphenyl)butane, etc; ethers such as 1,2-bis(phenoxy)ethane, 1,2-bis(4-methylphenoxy)ethane, 1,2-bis(3-methylphenoxy)ethane, 2-naphthol benzyl ether, etc; esters such as dibenzyl terephthalate, phenyl 1-hydroxy-2-naphthoate, etc; p-benzylbiphenyl, 2-(2'-hydroxy-5'-methylphenyl)benzotriazole, 2-hydroxy-4-benzyloxybenzophenone, 2-hydroxy-4-methoxy-4'-methylbenzophenone; and various known heat-fusible substances as a sensitizer.

As a substrate (support) to be coated, may be used a paper, plastic film, synthetic fiber paper or the like, but a paper is most preferably used from a viewpoint of cost, coating applicability, etc.

In the present heat sensitive recording material, the method of forming the recording layer is not particularly limited. For example, the coating composition is applied to a substrate by an air knife coater, blade coater, bar coater, gravure coater, curtain coater or like suitable means and dried.

The amount of coating composition, which is not limited particularly, is usually 2 to 12 g/m$^2$, preferably 3 to 10 g/m$^2$, based on dry weight.

In the present invention, when ethylene-acrylic acid copolymer salt or like olefin-acrylic acid copolymer salt is used as a binder, a heat sensitive recording material is obtained in which the record images hardly fade and the decrease of whiteness of the recording layer is extremely low when allowed to stand at a high temperature of 80° C. for a long time.

Therefore, the above heat sensitive recording material is very suitable to those used for a thermal facsimile device which is installed in a car. In this case, 3-di(n-butyl)amino-6-methyl-7-phenylaminofluoran or 3-di(n-butyl)amino-7-(o-chlorophenyl)aminofluoran is preferably used as a basic dye. Further, sticking is apt to occur in case of using an olefin-acrylic acid copolymer salt as a binder, it is necessary to form a later-mentioned protective layer on the recording layer.

In the present invention, it is possible to form on the recording layer a protective layer which contains a water-soluble high polymer as a main component, in order to protect the recording layer or enhance recording suitability such as prevention of sticking.

Examples of useful water-soluble high polymers are starches, hydroxyethyl cellulose, methyl cellulose, carboxymethyl cellulose, gelatin, casein, gum arabic, polyvinyl alcohol, acetoacetylated polyvinyl alcohol, carboxylated polyvinyl alcohol, diisobutylene-maleic anhydride copolymer salt, styrene-maleic anhydride copolymer salt, styrene-acrylic acid copolymer salt, etc.

Generally, an aqueous coating composition is used as a coating composition for a protective layer.

In order to improve printability or sticking, a pigment is added as required to the coating composition for the protective layer. Examples of useful pigments are calcium carbonate, zinc oxide, aluminum oxide, titanium dioxide, silicon dioxide, aluminum hydroxide, barium sulfate, zinc sulfate, talc, kaolin, clay, calcined clay, colloidal silica or like inorganic pigment; styrene microball, nylon powder, polyethylene powder, urea-formalin resin filler, raw starch particle or like organic pigment. The amount of pigment is preferably about 5 to 500 parts by weight per 100 parts by weight of the water-soluble high polymer.

Further, to the composition may be added as required an emulsion of SBR, NBR, acrylic resin or like hydrophobic high polymer; zinc stearate, calcium stearate, stearic acid amide, polyethylene wax, carnauba wax, paraffin wax, ester wax or like waxes; dispersants; defoaming agents; curing agents; gelation agents; and other various auxiliary agents.

The coating composition for the protective layer is applied by an appropriate coating apparatus to the recording layer and dried. The amount of the coating composition is usually about 0.05 to 5 g/m$^2$, preferably 0.5 to 3 g/m$^2$.

Since a specific benzene derivative is contained in the recording layer, the present heat sensitive recording material is extremely improved in the preservability of the record images, hardly foggs and is excellent in whiteness of the recording layer.

Various other known techniques in the field of heat sensitive recording material can be applied. For example, it is possible to form a protective layer on the rear surface of the support, to form a primary coating layer between the support and the heat sensitive recording layer, to form an adhesive layer on the rear surface of the support.

The invention will be described below in more detail with reference to Examples by no means limited to, in which parts and percentages are all by weight, unless otherwise specified.

EXAMPLE 1

(1) Composition (A)

| | |
|---|---|
| 3-(N-Ethyl-N-isoamyl)amino-6-methyl-7-phenylaminofluoran | 10 parts |
| 5% Aqueous solution of methyl cellulose | 5 parts |
| Water | 40 parts |

These components were pulverized by a sand mill to prepare Composition (A) having an average particle size of 2.0 μm.

(2) Composition (B)

| | |
|---|---|
| Benzyl 4-hydroxybenzoate | 20 parts |
| 5% Aqueous solution of methyl cellulose | 5 parts |
| Water | 55 parts |

These components were pulverized by a sand mill to prepare Composition (B) having an average particle size of 2.0 μm.

(3) Composition (C)

| | |
|---|---|
| 1-[α-Methyl-α-(4'-hydroxyphenyl)ethyl]-4-[α',α'-bis(4''-hydroxyphenyl)ethyl]benzene | 7 parts |
| 5% Aqueous solution of methyl cellulose | 3 parts |
| Water | 25 parts |

These components were pulverized by a sand mill to prepare Composition (C) having an average particle size of 2.0 μm.

(4) Formation of a recording layer

A coating composition was prepared by mixing with stirring 55 parts of Composition (A), 80 parts of Composition (B), 35 parts of Composition (C), 15 parts of finely divided anhydrous silica (oil absorption: 180 ml/100 g), 50 parts of 20% aqueous solution of polyvinyl alcohol and 10 parts of water. To a paper substrate weighing 50 g/m$^2$ was applied and dried the above coating composition in an amount of 6 g/m$^2$ by dry weight to obtain a heat sensitive recording paper.

EXAMPLE 2

A heat sensitive recording paper was prepared in the same manner as in Example 1 except that, in the preparation of Composition (C), 1-[α-methyl-α-(4'-hydroxyphenyl)ethyl]-3-[α',α'-bis(4''-hydroxyphenyl)ethyl]benzene was used in place of 1-[α-methyl-α-(4'-hydroxyphenyl)ethyl]-4-[α',α'-bis(4''-hydroxyphenyl)ethyl]benzene.

EXAMPLE 3

A heat sensitive recording paper was prepared in the same manner as in Example 1 except that, in the preparation of Composition (C), 1-[α-methyl-α-(3',5'-dimethyl-4'-hydroxyphenyl)ethyl]-4-[α',α'-bis(3'',5''-dimethyl-4''-hydroxyphenyl)ethyl]benzene was used in place of 1-[α-methyl-α-(4'-hydroxyphenyl)ethyl]-4-[α',α'-bis(4''-hydroxyphenyl)ethyl]benzene.

EXAMPLE 4

(1) Composition (D)

| | |
|---|---|
| 3-(N-Ethyl-N-isoamyl)amino-6-methyl-7-phenylaminofluoran | 10 parts |
| 1,2-Bis(3-methylphenoxy)ethane | 25 parts |
| 5% Aqueous solution of methyl cellulose | 5 parts |
| Water | 50 parts |

These components were pulverized by a sand mill to prepare Composition (D) having an average particle size of 2.0 μm.

(2) Composition (E)

| | |
|---|---|
| 4,4'-Isopropylidenediphenol | 20 parts |
| 5% Aqueous solution of methyl cellulose | 5 parts |
| Water | 55 parts |

These components were pulverized by a sand mill to prepare Composition (E) having an average particle size of 2.0 μm.

(3) Composition (F)

| | |
|---|---|
| 1-[α-Methyl-α-(4'-hydroxyphenyl)ethyl]-4-[α',α'-bis(4''-hydroxyphenyl)ethyl]benzene | 7 parts |
| 5% Aqueous solution of methyl cellulose | 3 parts |
| Water | 25 parts |

These components were pulverized by a sand mill to prepare Composition (F) having an average particle size of 2.0 μm.

(4) Formation of a recording layer

A coating composition was prepared by mixing with stirring 90 parts of Composition (D), 80 parts of Composition (E), 35 parts of Composition (F), 15 parts of finely divided anhydrous silica (oil absorption: 180 ml/100 g), 50 parts of 20% aqueous solution of polyvinyl alcohol and 10 parts of water. To a paper substrate weighing 50 g/m$^2$ was applied and dried the above coating composition in an amount of 6 g/m$^2$ by dry weight to obtain a heat sensitive recording paper.

EXAMPLE 5

A heat sensitive recording paper was prepared in the same manner as in Example 4 except that, in the preparation of Composition (F), 1-[α-methyl-α-(4'-hydroxyphenyl)ethyl]-3-[α',α'-bis(4''-hydroxyphenyl)ethyl]benzene was used in place of 1-[α-methyl-α-(4'-hydroxyphenyl)ethyl]-4-[α',α'-bis(4''-hydroxyphenyl)ethyl]benzene.

EXAMPLE 6

A heat sensitive recording paper was prepared in the same manner as in Example 4 except that, in the preparation of Composition (F), 1-[α-methyl-α-(3',5'-dimethyl-4'-hydroxyphenyl)ethyl]-4-[α',α'-bis(3'',5''-dimethyl-4''-hydroxyphenyl)ethyl]benzene was used in place of 1-[α-methyl-α-(4'-hydroxyphenyl)ethyl]-4-[α',α'-bis(4''-hydroxyphenyl)ethyl]benzene.

EXAMPLE 7

(1) Composition (G)

| | |
|---|---|
| 3-Di(n-butyl)amino-6-methyl-7-phenylaminofluoran | 10 parts |
| 1,2-Bis(3-methylphenoxy)ethane | 25 parts |
| 5% Aqueous solution of methyl cellulose | 5 parts |
| Water | 50 parts |

These components were pulverized by a sand mill to prepare Composition (G) having an average particle size of 2.0 μm.

(2) Composition (H)

| | |
|---|---|
| 4-Hydroxy-4'-isopropoxydiphenylsulfone | 20 parts |
| 5% Aqueous solution of methyl cellulose | 5 parts |
| Water | 55 parts |

These components were pulverized by a sand mill to prepare Composition (H) having an average particle size of 2.0 μm.

(3) Composition (I)

| | |
|---|---|
| 1-[α-Methyl-α-(4'-hydroxyphenyl)ethyl]-4-[α',α'-bis(4''-hydroxyphenyl)ethyl]benzene | 7 parts |
| 5% Aqueous solution of methyl cellulose | 3 parts |
| Water | 25 parts |

These components were pulverized by a sand mill to prepare Composition (I) having an average particle size of 2.0 μm.

(4) Formation of a recording layer

A coating composition was prepared by mixing with stirring 90 parts of Composition (G), 80 parts of Composition (H), 35 parts of Composition (I), 15 parts of finely divided anhydrous silica (oil absorption: 180 ml/100 g), 50 parts of 20% aqueous solution of polyvinyl alcohol and 10 parts of water. To a paper substrate weighing 50 g/m$^2$ was applied and dried the above coating composition in an amount of 6 g/m$^2$ by dry weight to obtain a heat sensitive recording paper.

EXAMPLE 8

A heat sensitive recording paper was prepared in the same manner as in Example 7 except that, in the preparation of Composition (G), 3-di(n-butyl)amino-7-(o-chlorophenyl)aminofluoran was used in place of 3-di(n-butyl)amino-6-methyl-7-phenylaminofluoran.

COMPARISON EXAMPLE 1

A heat sensitive recording paper was prepared in the same manner as in Example 1 except that Composition (C) was not used.

COMPARISON EXAMPLE 2

A heat sensitive recording paper was prepared in the same manner as in Example 4 except that Composition (F) was not used.

COMPARISON EXAMPLE 3

A heat sensitive recording paper was prepared in the same manner as in Example 7 except that Composition (I) was not used.

COMPARISON EXAMPLE 4

A heat sensitive recording paper was prepared in the same manner as in Example 8 except that Composition (I) was not used.

COMPARISON EXAMPLE 5

(1) Composition (J)

| | |
|---|---|
| 1,1,3-Tris(2-methyl-4-hydroxy-5-tert-butylphenyl)butane | 7 parts |
| 5% Aqueous solution of methyl cellulose | 3 parts |
| Water | 25 parts |

These components were pulverized by a sand mill to prepare Composition (J) having an average particle size of 2.0 μm.

(2) Formation of a recording layer

A heat sensitive recording paper was prepared in the same manner as in Example 7 except that, in the formation of the recording layer, 35 parts of Composition (J) was used in place of 35 parts of Composition (I).

COMPARISON EXAMPLE 6

(1) Composition (K)

| | |
|---|---|
| 1,1,3-Tris(2-methyl-4-hydroxy-5-cyclohexylphenyl)butane | 7 parts |
| 5% Aqueous solution of methyl cellulose | 3 parts |
| Water | 25 parts |

These components were pulverized by a sand mill to prepare Composition (K) having an average particle size of 2.0 μm.

(2) Formation of a recording layer

A heat sensitive recording paper was prepared in the same manner as in Example 7 except that, in the formation of the recording layer, 35 parts of Composition (K) was used in place of 35 parts of Composition (I).

The obtained fourteen kinds of the heat sensitive recording papers were evaluated as follows.

Whiteness

The whiteness of the heat sensitive recording paper was measured with use of a Hunter multipurpose reflectometer. The results are given in Table 2.

Recording density

The heat sensitive recording paper was fed to a thermal facsimile system (Hitachi HIFAX-400 Model) and a test chart was supplied for recording and checked for recording density ($D_1$) by Macbeth densitometer (Model RD-100R, with an amber filter). Table 1 shows the results.

Resistance to humidity

The heat sensitive recording papers with the record images were further allowed to stand at 40° C. and 90% RH for 24 hours and then similarly checked for recording density ($D_2$) to determine percent recording density retention. Table 1 shows the results. Percent recording density retention $= D_2/D_1 \times 100$

Resistance to heat

The heat sensitive recording papers with the record images were further allowed to stand at 60° C. and 10% RH for 24 hours and then similarly checked for recording density ($D_3$) to determine percent recording density retention. Table 1 shows the results. Percent recording density retention $= D_3/D_1 \times 100$

Fogging (Undesired color formation)

The heat sensitive recording papers before recording were allowed to stand at 40° C. and 90% RH for 24 hours (resistance to humidity test) and at 60° C. and 10% RH for 24 hours (resistance to heat test) respectively, and then similarly checked for color density in the surface of the paper by Macbeth densitometer. The results are shown in Table 2.

TABLE 1

| | Recording density | | | Percent recording density retention | |
|---|---|---|---|---|---|
| | $D_1$ | $D_2$ | $D_3$ | $D_2/D_1$ | $D_3/D_1$ |
| Ex. 1 | 1.29 | 0.95 | 1.07 | 74 | 83 |
| Ex. 2 | 1.28 | 0.94 | 1.06 | 73 | 83 |
| Ex. 3 | 1.28 | 0.94 | 1.06 | 74 | 83 |
| Ex. 4 | 1.35 | 1.31 | 1.09 | 97 | 81 |
| Ex. 5 | 1.31 | 1.29 | 1.08 | 98 | 82 |
| Ex. 6 | 1.31 | 1.29 | 1.07 | 98 | 82 |
| Ex. 7 | 1.30 | 1.25 | 1.09 | 96 | 84 |
| Ex. 8 | 1.20 | 0.84 | 0.90 | 70 | 75 |
| Com. Ex. 1 | 1.27 | 0.42 | 0.77 | 33 | 61 |
| Com. Ex. 2 | 1.31 | 1.16 | 0.95 | 89 | 71 |
| Com. Ex. 3 | 1.29 | 1.00 | 0.85 | 78 | 66 |
| Com. Ex. 4 | 1.18 | 0.48 | 0.58 | 41 | 49 |
| Com. Ex. 5 | 1.29 | 1.15 | 1.01 | 89 | 78 |
| Com. Ex. 6 | 1.29 | 1.05 | 0.93 | 81 | 72 |

*($D_2$) Recording density after treated at 40° C. and 90% RH for 24 hours
*($D_3$) Recording density after treated at 60° C. and 10% RH for 24 hours

TABLE 2

| | Whiteness | Fogging | |
|---|---|---|---|
| | (%) | Res. to humidity | Res. to heat |
| Ex. 1 | 86.6 | 0.11 | 0.18 |
| Ex. 2 | 86.3 | 0.11 | 0.19 |
| Ex. 3 | 86.5 | 0.11 | 0.19 |
| Ex. 4 | 82.6 | 0.14 | 0.16 |
| Ex. 5 | 82.5 | 0.13 | 0.15 |
| Ex. 6 | 82.4 | 0.14 | 0.14 |
| Ex. 7 | 87.0 | 0.09 | 0.12 |
| Ex. 8 | 87.5 | 0.05 | 0.07 |
| Com. Ex. 1 | 86.8 | 0.10 | 0.17 |
| Com. Ex. 2 | 84.6 | 0.12 | 0.14 |
| Com. Ex. 3 | 87.2 | 0.08 | 0.11 |
| Com. Ex. 4 | 87.6 | 0.04 | 0.06 |
| Com. Ex. 5 | 84.5 | 0.13 | 0.18 |
| Com. Ex. 6 | 84.0 | 0.12 | 0.16 |

EXAMPLE 9

(1) Composition (L)

| | |
|---|---|
| 3-Di(n-butyl)amino-6-methyl-7-phenylaminofluoran | 10 parts |
| 1,2-Bis(3-methylphenoxy)ethane | 25 parts |
| 5% Aqueous solution of methyl cellulose | 20 parts |
| Water | 45 parts |

These components were pulverized by a sand mill to prepare Composition (L) having an average particle size of 2.5 μm.

(2) Composition (M)

| | |
|---|---|
| 4,4'-Isopropylidenediphenol | 30 parts |
| 5% Aqueous solution of methyl cellulose | 30 parts |
| Water | 13 parts |

These components were pulverized by a sand mill to prepare Composition (M) having an average particle size of 2.5 μm.

(3) Composition (N)

| | |
|---|---|
| 1-[α-Methyl-α-(4'-hydroxyphenyl)ethyl]-4-[α',α'-bis(4''-hydroxyphenyl)ethyl]benzene | 10 parts |
| 5% Aqueous solution of methyl cellulose | 10 parts |
| Water | 13 parts |

These components were pulverized by a sand mill to prepare Composition (N) having an average particle size of 2.5 μm.

(4) Formation of a recording layer

A coating composition for a heat sensitive recording layer was prepared by mixing with stirring 100 parts of Composition (L), 73 parts of Composition (M), 33 parts of Composition (N), 7 parts of finely divided anhydrous silica, 25 parts of ethylene-acrylic acid copolymer salt (Zaikthene NC, 29% solid concentration, Seitetsu Kagaku Co., Ltd.) and 69.5 parts of water. To a paper substrate weighing 48 g/m$^2$ was applied and dried the above coating composition in an amount of 6 g/m$^2$ by dry weight to form a heat sensitive recording layer.

(5) Formation of a protective layer

| | |
|---|---|
| 4% Aqueous solution of polyvinyl alcohol (PVA 124, Kuraray Co., Ltd.) | 520 parts |
| 4% Aqueous solution of polyvinyl alcohol (PVA 235, Kuraray Co., Ltd.) | 230 parts |
| 20% Dispersion of kaolin | 225 parts |
| 30% Dispersion of zinc stearate | 25 parts |
| 4% Aqueous solution of boric acid | 38 parts |

These components were mixed with stirring to prepare a coating composition for a protective layer.

To the above heat sensitive recording layer was applied and dried the coating composition in an amount of 2 g/m$^2$ by dry weight to obtain a heat sensitive recording paper having a protective layer.

EXAMPLE 10

A heat sensitive recording paper having a protective layer was prepared in the same manner as in Example 9 except that, in the preparation of Composition (L), 3-di(n-butyl)amino-7-(o-chlorophenyl)aminofluoran was used in place of 3-di(n-butyl)amino-6-methyl-7-phenylaminofluoran and, in the preparation of Composition (M), 4-hydroxy-4'-isopropoxydiphenylsulfone was used in place of 4,4'-isopropylidenediphenol.

COMPARISON EXAMPLE 7

A heat sensitive recording paper having a protective layer was prepared in the same manner as in Example 9 except that Composition (N) was not used in the preparation of the coating composition for the heat sensitive recording layer.

REFERENCE EXAMPLE 1

A heat sensitive recording paper having a protective layer was prepared in the same manner as in Example 9 except that 72.5 parts of 10% aqueous solution of polyvinyl alcohol (PVA 110, Kuraray Co., Ltd.) was used in place of 25 parts of 29% aqueous solution of ethylene-acrylic acid copolymer salt in the preparation of the coating composition for the heat sensitive recording layer.

REFERENCE EXAMPLE 2

A heat sensitive recording paper was prepared in the same manner as in Example 9 except that a protective layer was not formed.

COMPARISON EXAMPLE 8

A heat sensitive recording paper was prepared in the same manner as in Reference Example 1 except that, Composition (N) was not used in the preparation of the coating composition for the heat sensitive recording layer, and a protective layer was not formed.

The obtained six kinds of the heat sensitive recording papers were evaluated as follows. The results were given in Table 3.

Whiteness

The whiteness of the heat sensitive recording paper was measured with use of a Hunter multipurpose reflectometer.

Recording density

The heat sensitive recording paper was fed to a thermal facsimile system (NTT, NTTFAX-21 S) and a test chart was supplied for recording and checked for recording density by Macbeth densitometer.

Resistance to heat

The heat sensitive recording papers with the record images were allowed to stand at 80° C. for 24 hours and then similarly checked for recording density by Macbeth densitometer to examine the preservability of the record images. Further, the background portion (non-printed portion) of the recording paper was checked for color density by Macbeth densitometer to examine fogging.

Sticking

The heat sensitive recording paper was fed to the above thermal facsimile system and a black paper in whole area was supplied to observe the degree of sticking.

Evaluation criteria

O: No sticking
Δ: A little sticking but practically no problem
X: Marked sticking and unsuited to practical use

TABLE 3

| | Whiteness (%) | Recording density | Resistance to heat: Recorded portion | Resistance to heat: Background portion | Sticking |
|---|---|---|---|---|---|
| Ex. 9 | 82.6 | 1.32 | 1.25 | 0.17 | |
| Ex. 10 | 86.3 | 1.29 | 1.25 | 0.15 | |
| Com. Ex. 7 | 83.0 | 1.33 | 0.90 | 0.16 | |
| Ref. Ex. 1 | 82.0 | 1.25 | 1.23 | 0.28 | Δ |
| Ref. Ex. 2 | 82.2 | 1.35 | 1.29 | 0.16 | X |
| Com. Ex. 8 | 81.5 | 1.30 | 0.75 | 0.27 | X |

The heat sensitive recording paper of the present invention is excellent in the preservability of the record images and hardly produces fogging with the improvement of the preservability of the record images.

We claim:

1. In a heat sensitive recording material comprising a substrate and a heat sensitive recording layer thereon incorporating a colorless or light-colored basic dye and a color acceptor which is reactive with the dye to form a color when contacted therewith, the recording material characterized in that at least one of the compounds of the formula (I) is contained in the heat sensitive recording layer.

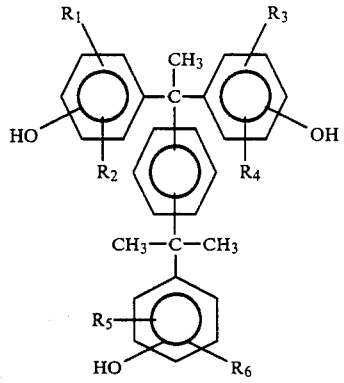

(I)

wherein $R_1$, $R_2$, $R_3$, $R_4$, $R_5$ and $R_6$ are the same or different and are hydrogen atom, halogen atom, $C_1 \sim C_5$ alkyl or $C_1 \sim C_5$ alkoxyl.

2. A heat sensitive recording material as defined in claim 1 wherein the compound of the formula (I) is used in an amount of 1 to 1000 parts by weight per 100 parts by weight of the color acceptor.

3. A heat sensitive recording material as defined in claim 1 wherein the basic dye is 3-di(n-butyl)amino-6-methyl-7-phenylaminofluoran, 3-(N-ethyl-N-isoamyl-)amino-6-methyl-7-phenylaminofluoran or 3-di(n-butyl-)amino-7-(o-chlorophenyl)aminofluoran.

4. A heat sensitive recording material as defined in claim 1 wherein the color acceptor is used in an amount of 100 to 700 parts by weight per 100 parts by weight of the basic dye.

5. A heat sensitive recording material as defined in claim 1 wherein an olefin-acrylic acid copolymer salt is used as a binder in the heat sensitive recording layer.

6. A heat sensitive recording material as defined in claim 5 which is suitable for use in a thermal facsimile device installed in a car.

7. A heat sensitive recording material as defined in claim 1 wherein a protective layer is further formed on the recording layer.

* * * * *